US009784124B2

(12) United States Patent
Oki

(10) Patent No.: US 9,784,124 B2
(45) Date of Patent: Oct. 10, 2017

(54) TURBOCHARGER

(71) Applicant: TOYOTA JIDOSHA KABUSHIKI KAISHA, Toyota-shi, Aichi-ken (JP)

(72) Inventor: Toshinori Oki, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 266 days.

(21) Appl. No.: 14/558,242

(22) Filed: Dec. 2, 2014

(65) Prior Publication Data

US 2015/0176429 A1 Jun. 25, 2015

(30) Foreign Application Priority Data

Dec. 25, 2013 (JP) ..... 2013-267641

(51) Int. Cl.

| | |
|---|---|
| ***F01D 25/14*** | (2006.01) |
| ***F01D 25/12*** | (2006.01) |
| ***F02B 39/00*** | (2006.01) |
| ***F01D 25/04*** | (2006.01) |

(52) U.S. Cl.

CPC ..... *F01D 25/12* (2013.01); *F01D 25/04* (2013.01); *F01D 25/14* (2013.01); *F01D 25/145* (2013.01); *F02B 39/005* (2013.01); *F05D 2220/40* (2013.01); *F05D 2260/231* (2013.01); *F05D 2260/96* (2013.01); *F05D 2300/5024* (2013.01)

(58) Field of Classification Search

CPC .... F04D 29/403; F04D 29/5853; F01D 25/12; F01D 25/14; F01D 25/145; F01D 25/26; F01N 3/043; F01N 3/046

See application file for complete search history.

(56) References Cited

U.S. PATENT DOCUMENTS

| | | | | |
|---|---|---|---|---|
| 4,147,467 | A * | 4/1979 | Leicht | F01D 25/14 415/196 |
| 8,365,526 | B2 * | 2/2013 | Stiermann | F01D 25/14 60/599 |
| 2008/0295516 | A1 | 12/2008 | Teshima et al. | |
| 2011/0154818 | A1 | 6/2011 | Takahata | |
| 2011/0252775 | A1 | 10/2011 | Joergl et al. | |

(Continued)

FOREIGN PATENT DOCUMENTS

| | | | |
|---|---|---|---|
| EP | 1806489 | A1 | 7/2007 |
| GB | 2126663 | A | 3/1984 |
| JP | 2006-220131 | A | 8/2006 |

(Continued)

*Primary Examiner* — Justin Seabe
(74) *Attorney, Agent, or Firm* — Oliff PLC

(57) ABSTRACT

A turbocharger includes a turbine housing adapted to be arranged in the middle of an engine exhaust passage, a bearing housing coupled to the turbine housing, a turbine wheel located inside the turbine housing, a rotary shaft that is connected to the turbine wheel and is rotationally supported by the bearing housing, and a cooling water passage that is provided inside the turbine housing. The cooling water passage is located around the turbine wheel. The turbine housing includes a first connection portion joined to the bearing housing, a second connection portion joined to a part of the engine exhaust passage located on a downstream side of the turbine housing, and a heat insulating portion located between the cooling water passage and at least one of the first connection portion and the second connection portion.

3 Claims, 2 Drawing Sheets

(56) References Cited

U.S. PATENT DOCUMENTS

| | | | |
|---|---|---|---|
| 2012/0201655 | A1 | 8/2012 | Kusakabe et al. |
| 2014/0369811 | A1 | 12/2014 | Malins et al. |

FOREIGN PATENT DOCUMENTS

| | | | |
|---|---|---|---|
| JP | 2009-270468 | A | 11/2009 |
| JP | A-2010-048187 | | 3/2010 |
| JP | A-2010-059807 | | 3/2010 |
| WO | 2010/039590 | A2 | 4/2010 |
| WO | 2011/053513 | A2 | 5/2011 |
| WO | 2013/112345 | A1 | 8/2013 |

* cited by examiner

TURBOCHARGER

BACKGROUND OF THE INVENTION

The present invention relates to a turbocharger that includes a water-cooled turbine housing.

A turbocharger includes a turbine housing and a bearing housing, which are coupled to each other. A rotary shaft is connected to a turbine wheel arranged inside the turbine housing so that the rotary shaft can rotate integrally with the turbine wheel. The rotary shaft is supported by the bearing housing.

In the turbocharger disclosed in Japanese Laid-Open Patent Publication No. 2010-48187, a water passage through which cooling water circulates is provided inside a turbine housing. In turbochargers having this type of water-cooled turbine housing, the turbine housing is cooled through heat exchange performed with cooling water flowing through the water passage and is prevented from being overheated.

During operation of the turbocharger, vibrations occur as a result of the integral rotation of the turbine wheel and the rotary shaft. Such vibrations are transmitted to the bearing housing, which supports the rotary shaft. The vibrations transmitted to the bearing housing are also transmitted through the turbine housing to a downstream-side portion of an exhaust passage joined to the turbine housing and contribute to noise generation.

In addition, in turbochargers including a water-cooled turbine housing, the temperature of the turbine housing is comparatively low, and therefore the rigidity of the turbine housing rises, and the vibration transmissibility is high. Therefore, the vibrations that have been transmitted from the rotary shaft to the bearing housing are liable to be transmitted to the downstream-side portion of the exhaust passage through the turbine housing, and therefore noise is easily generated.

SUMMARY OF THE INVENTION

It is an objective of the present invention to provide a turbocharger that is capable of reducing vibrations of a downstream-side portion of an exhaust passage and restraining noise generation caused by such vibrations.

To achieve the foregoing objective and in accordance with one aspect of the present invention, a turbocharger is provided that includes a turbine housing adapted to be arranged in the middle of an engine exhaust passage, a bearing housing coupled to the turbine housing, a turbine wheel arranged inside the turbine housing, a rotary shaft that is connected to the turbine wheel to be rotational integrally with the turbine wheel and that is rotationally supported by the bearing housing, and a cooling water passage that is provided inside the turbine housing and that is used to circulate cooling water. The cooling water passage is located around the turbine wheel. The turbine housing includes a first connection portion joined to the bearing housing, a second connection portion joined to a part of the engine exhaust passage located on a downstream side of the turbine housing, and a heat insulating portion located between the cooling water passage and at least one of the first connection portion and the second connection portion.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A turbocharger 10 according to one embodiment will be described hereinafter.

Figure 1:
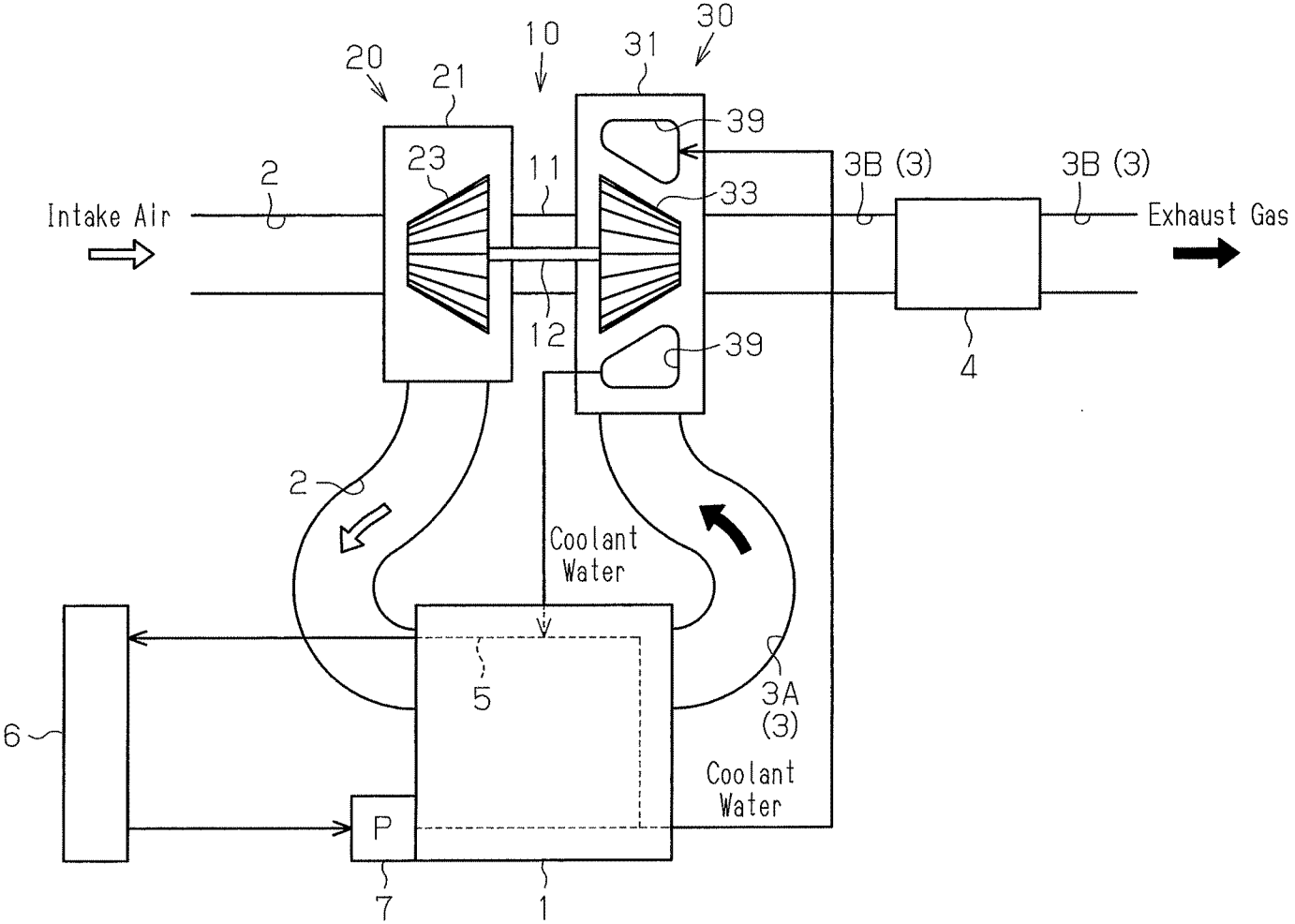
FIG. 1 is a cross-sectional view of a turbocharger according to a one embodiment.

As shown in FIG. 1, the turbocharger 10 includes a compressor 20 located in the middle of an intake passage 2 of an internal combustion engine 1, a turbine 30 located in the middle of an exhaust passage 3 of the internal combustion engine 1, and a bearing housing 11, which couples the compressor 20 and the turbine 30 to each other.

The compressor 20 has a compressor housing 21, which accommodates a compressor impeller 23. The turbine 30 has a turbine housing 31, which accommodates a turbine wheel 33. The turbine wheel 33 and the compressor impeller 23 are connected to each other by a rotary shaft 12 to be integrally rotational. The rotary shaft 12 is rotationally supported by a bearing portion of the bearing housing 11.

Next, the turbine 30 and the structure around the turbine 30 will be described in detail.

Figure 2:
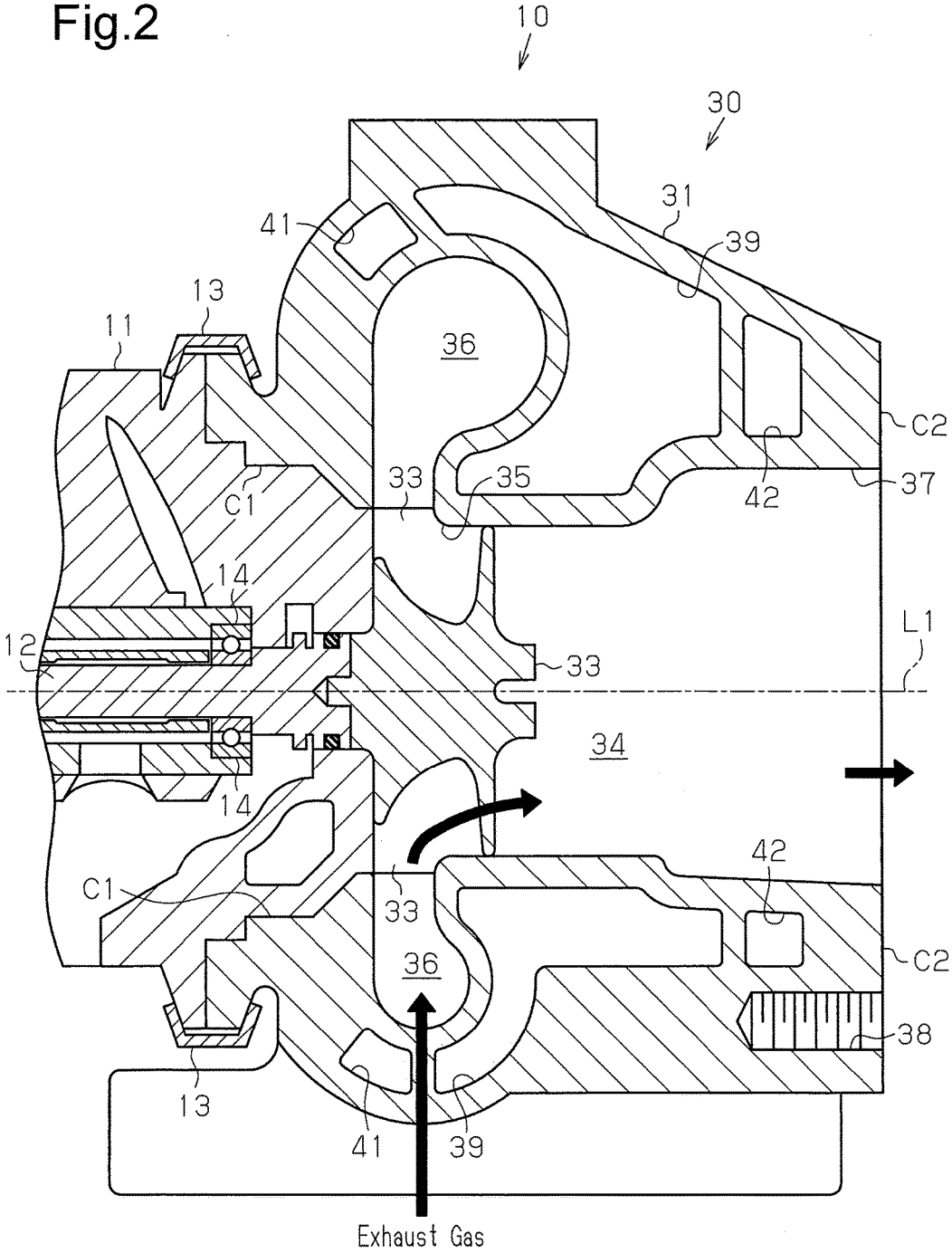
FIG. 2 is a cross-sectional view of the turbine housing.

As shown in FIG. 2, the turbine housing 31 accommodates a duct portion 34, which has a circular cross-sectional shape and an axis coinciding with a rotational axis L1 of the turbine wheel 33.

One end (the left side in FIG. 2) of the duct portion 34 defines a wheel chamber 35, and the turbine wheel 33 is located in the wheel chamber 35. A scroll passage 36, which extends in a spiral shape around the entire periphery of the turbine wheel 33, is located inside the turbine housing 31. The scroll passage 36 is opened in the peripheral wall of the wheel chamber 35 over its entire periphery. In other words, the scroll passage 36 has an annular opening that communicates with the wheel chamber 35. An upstream-side exhaust pipe 3A, which is an upstream-side part with respect to the turbine 30 in the exhaust passage 3, is connected to the scroll passage 36.

On the other hand, the end of the duct portion 34 opposite to the wheel chamber 35 (the right side in FIG. 2) defines a discharge portion 37, through which exhaust gas is discharged to the outside from the duct portion 34, and a downstream-side exhaust pipe 3B, which is a downstream-side part with respect to the turbine 30 in the exhaust passage 3, is connected to the discharge portion 37. The turbine housing 31 has threaded holes 38 around the discharge portion 37. The downstream-side exhaust pipe 3B is fixed to the turbine housing 31 by fastening bolts into the threaded holes 38. A part of the turbine housing 31 to which the downstream-side exhaust pipe 3B is joined will be referred to as a second connection portion C2.

The bearing housing 11 is fixed to the turbine housing 31 such that the duct portion 34 is located between the bearing housing 11 and the downstream-side exhaust pipe 3B in the direction of the rotational axis L1. The turbine housing 31 and the bearing housing 11 are coupled to each other by a V-band clamp 13. A part of the turbine housing 31 to which the bearing housing 11 is joined will be referred to as a first connection portion C1. A bearing portion 14 is formed inside the bearing housing 11, and the rotary shaft 12 is rotationally supported by the bearing portion 14.

As shown in FIGS. 1 and 2, forced induction to the internal combustion engine 1 is performed by the turbocharger 10 as follows. As shown by solid arrows in the figures, exhaust gas flowing through the inside of the exhaust passage 3 flows into the scroll passage 36 of the turbine housing 31 from the upstream-side exhaust pipe 3A, then flows into the wheel chamber 35 from the scroll passage 36, and is then blown onto the turbine wheel 33. As a result, the turbine wheel 33 rotates while receiving the energy of the flow of the exhaust gas, and the compressor impeller 23 rotates together with the turbine wheel 33. According to the rotation of the compressor impeller 23, air flowing into the compressor housing 21 is forcefully fed to the downstream side with respect to the compressor 20 in the intake passage 2 and is supercharged to the cylinder of the internal combustion engine 1 as shown by blank arrows in FIG. 1.

Exhaust gas that has passed through the turbine wheel 33 is discharged into the downstream-side exhaust pipe 3B from the discharge portion 37 of the duct portion 34 and is purified by an exhaust purifying device 4 (see FIG. 1) located at the downstream-side exhaust pipe 3B and is then discharged to the outside from the downstream-side exhaust pipe 3B.

A cooling water passage 39, through which cooling water circulates, is formed inside the turbine housing 31 to surround the scroll passage 36 and the duct portion 34. In other words, the turbine housing 31 is a water-cooled type and is cooled by forcibly circulating cooling water inside the cooling water passage 39 and by permitting heat exchange with the cooling water. The internal combustion engine 1 contains a water jacket 5, to which cooling water is supplied, and is connected to an engine cooling system that is composed mainly of a radiator 6, which cools cooling water, and a water pump 7, which forcefully feeds cooling water. In the present embodiment, during the operation of the internal combustion engine 1, some of the cooling water in the engine cooling system is supplied to the cooling water passage 39 and circulated.

During the operation of the turbocharger 10, vibrations occur as result of integral rotation of the turbine wheel 33 and the rotary shaft 12 and are transmitted to the bearing housing 11, which supports the rotary shaft 12. Vibrations transmitted to the bearing housing 11 are also transmitted to the downstream-side exhaust pipe 3B and to the exhaust purifying device 4 through the turbine housing 31, thus causing a noise generation.

Additionally, since the turbine housing 31 is cooled to have lower temperature and higher rigidity, its vibration transmissibility increases. Therefore, vibrations transmitted from the rotary shaft 12 to the bearing housing 11 are liable to be transmitted to the downstream-side exhaust pipe 3B through the turbine housing 31, and noise generation easily occurs.

In the present embodiment, the turbine housing 31 has the cooling water passage 39 surrounding the scroll passage 36 and the duct portion 34 as shown in FIG. 2. However, the cooling water passage 39 is not formed near the first connection portion C1 of the turbine housing 31, i.e., is not formed around a side of the scroll passage 36 that faces the bearing housing 11. Likewise, the cooling water passage 39 is not formed near the second connection portion C2 of the turbine housing 31, i.e., is not formed around a side of the duct portion 34 that corresponds to the discharge portion 37.

The turbine housing 31 has a substantially annular heat insulating portion 41, which extends around the entire periphery of the rotational axis L1 of the turbine wheel 33 between the first connection portion C1 and the cooling water passage 39. The turbine housing 31 also has a heat insulating portion 42, which extends around the entire periphery of the rotational axis L1 of the turbine wheel 33 between the second connection portion C2 and the cooling water passage 39. These heat insulating portions 41 and 42 are each formed of a cavity filled with air. The turbine housing 31 has an internal space that receives the turbine wheel 33, i.e., has an inner wall surface that defines the duct portion 34 and the scroll passage 36. The heat insulating portions 41 and 42 are each formed not to be opened in the inner wall surface of the turbine housing 31. Air with which each inside of the heat insulating portions 41 and 42 is filled functions as a heat insulating layer that restrains heat transmission.

The effect brought about by arranging the cooling water passage 39 and the heat insulating portions 41 and 42 inside the turbine housing 31 will now be described.

The first and second connection portions C1 and C2 of the turbine housing 31 form a part of a path along which vibrations are transmitted from the bearing housing 11 to the downstream-side exhaust pipe 3B and to the exhaust purifying device 4 (a vibration transmission path). Therefore, the vibration transmissibility of the part of the vibration transmission path can be lowered by lowering the vibration transmissibility of the part of the turbine housing 31 around the first connection portion C1 and the vibration transmissibility of the part of the turbine housing 31 around the second connection portion C2 Vibration transmission from the bearing housing 11 to downstream-side exhaust pipe 3B and to the exhaust purifying device 4 can thus be restrained.

In this respect, in the above described turbocharger 10, the cooling water passage 39 is not formed around the first connection portion C1 in the turbine housing 31, and the heat insulating portion 41 is formed between the first connection portion C1 and the cooling water passage 39. As a result, the first connection portion C1 is thermally insulated from the cooling water passage 39, so that the part around the first connection portion C1 is not cooled easily. Therefore, compared to a case in which the heat insulating portion 41 is not provided, it is possible to increase the temperature of the part around the first connection portion C1, thereby reducing its rigidity, so that the vibration transmissibility of that part is lowered. Therefore, vibration transmission from the bearing housing 11 to the turbine housing 31 is restrained.

Furthermore, the cooling water passage 39 is not formed around the second connection portion C2 in the turbine housing 31, and the heat insulating portion 42 is formed between the second connection portion C2 and the cooling water passage 39. As a result, the second connection portion C2 is thermally insulated from the cooling water passage 39, so that the part around the second connection portion C2 is not cooled easily. Therefore, it is possible to increase the temperature of the part around the second connection portion C2, to reduce its rigidity and to lower the vibration transmissibility of that part compared to an example in which the heat insulating portion 42 is not provided. Therefore, it is possible to restrain vibration transmission from the turbine housing 31 to the downstream-side exhaust pipe 3B and to the exhaust purifying device 4.

As described above, it is possible to lower the vibration transmissibility of the part around the first connection portion C1, which is a part of the vibration transmission path, and the vibration transmissibility of the part of the second connection portion C2, which is a part of the vibration transmission path. Therefore, it is possible to restrain vibration transmission from the bearing housing 11 to the downstream-side exhaust pipe 3B and to the exhaust purifying device 4, and it is possible to restrain noise generation resulting from vibrations of the downstream-side exhaust pipe 3B and of the exhaust purifying device 4. Moreover, the vibration transmissibility of the part around the first connection portion C1 is low, and therefore vibration transmission from the bearing housing 11 to the turbine housing 31 is restrained, and vibrations of the turbine housing 31 itself are also restrained.

In the turbine housing 31, the temperature of the area around the turbine wheel 33, i.e., the temperature of the area including the inner wall (the so-called shroud) of the wheel chamber 35 and its neighboring parts is liable to rise, and therefore this area is desired to be cooled. In this respect, the cooling water passage 39 is arranged around the turbine wheel 33 in the turbocharger 10, and therefore it is possible to cool the parts that are desired to be cooled. Additionally, the heat insulating portions 41 and 42, each of which is a cavity, are not opened in the inner wall surface of the duct portion 34 or in the inner wall surface of the scroll passage 36. Therefore, high-temperature exhaust gas does not flow into the heat insulating portions 41 and 42. Therefore, it is possible to restrain the part around the turbine wheel 33 from being overheated.

Moreover, the cooling water passage 39 is not provided at the part of the turbine housing 31 around the first connection portion C1 or at the part of the turbine housing 31 around the second connection portion C2, i.e., is not provided at a part separated from the inner wall of the wheel chamber 35. Therefore, it is possible to specifically cool the neighboring part of the turbine wheel 33.

Additionally, in the turbocharger 10, the amount of heat received by cooling water from the turbine housing 31 is smaller, and the temperature of this cooling water is lower than those in an example in which the cooling water passage is arranged both at the part around the first connection portion C1 and at the part around the second connection portion C2. Therefore, even if cooling water that has passed through the turbine housing 31 and that has become higher in temperature is returned directly to the internal combustion engine 1, the cooling efficiency of the internal combustion engine 1 is properly restrained from being deteriorated. Therefore, in the turbocharger 10, it is possible to reduce the capacity of the radiator 6 for cooling water.

Additionally, since the amount of heat received by cooling water from the turbine housing 31 is small, it is difficult for the temperature of exhaust gas passing through the inside of the turbine housing 31 to fall. As a result, comparatively high-temperature exhaust gas passes through the inside of the exhaust purifying device 4. Therefore, it is possible to raise at an early stage the temperature of the exhaust purifying device 4 when the internal combustion engine 1 is cold-started, and it is possible to improve the exhaust purification performance.

Additionally, since the temperature of the part of the turbine housing 31 around the first connection portion C1 is high, the amount of heat transferred from the turbine housing 31 to the bearing housing 11 is increased. Therefore, it is possible to raise at an early stage the temperature of the bearing portion 14 in the bearing housing 11 when the internal combustion engine 1 is cold-started, and it is possible to reduce friction in the bearing portion 14.

As described above, the present embodiment provides the following advantages.

(1) The turbine housing 31 has the cooling water passage 39 around the turbine wheel 33 and the heat insulating portion 41 between the cooling water passage 39 and the first connection portion C1, which is joined to the bearing housing 11. The turbine housing 31 also has the heat insulating portion 42 between the cooling water passage 39 and the second connection portion C2, which is joined to the downstream-side exhaust pipe 3B. Therefore, it is possible to restrain vibration transmission from the bearing housing 11 to the downstream-side exhaust pipe 3B and to the exhaust purifying device 4, and it is possible to restrain noise generation resulting from vibrations of the downstream-side exhaust pipe 3B and of the exhaust purifying device 4. Additionally, it is possible to properly cool the part around the turbine wheel 33, which is desired to be cooled.

(2) A simple structure in which a cavity that functions as the heat insulating portion 41 or 42 is formed in the turbine housing 31 thermally insulates the first connection portion C1 from the cooling water passage 39 and thermally insulates the second connection portion C2 from the cooling water passage 39.

(3) The heat insulating portions 41 and 42, each of which is a cavity, are not opened in the inner wall surface of the duct portion 34 or in the inner wall surface of the scroll passage 36. Therefore, it is possible to restrain the part around the turbine wheel 33 from being overheated.

The above illustrated embodiment may be modified as follows.

The heat insulating portion 41 or the heat insulating portion 42 may be omitted.

Dedicated cooling water may be supplied to and circulated through the cooling water passage 39 in the turbine housing 31 instead of the configuration in which cooling water used to cool the internal combustion engine 1 is supplied to and circulated through the cooling water passage 39 in the turbine housing 31.

In the above illustrated embodiment, the cavities formed inside the turbine housing 31 are allowed to function as the heat insulating portions 41 and 42. Instead of this, a heat insulating portion made of a porous material having high heat-resisting properties (e.g., ceramic material) may be provided inside the turbine housing 31 by a technique such as casting.

Therefore, the present examples and embodiments are to be considered as illustrative and not restrictive and the invention is not to be limited to the details given herein, but may be modified within the scope and equivalence of the appended claims.

The invention claimed is:

1. A turbocharger comprising:

a turbine housing adapted to be arranged in an engine exhaust passage;

a bearing housing coupled to the turbine housing;

a turbine wheel arranged in an internal space of the turbine housing;

a rotary shaft that is connected to the turbine wheel to rotate with the turbine wheel and that is rotationally supported by the bearing housing; and a cooling water passage that is provided inside the turbine housing and that is used to circulate cooling water, wherein the cooling water passage is located around the turbine wheel, the turbine housing includes a first connection portion joined to the bearing housing, a second connection portion joined to a part of the engine exhaust passage located on a downstream side of the turbine housing, and a heat insulating portion located between the cooling water passage and both of the first connection portion and the second connection portion, the turbine housing has an inner wall surface that defines the internal space that receives the turbine wheel, the heat insulating portion is provided inside the turbine housing without being exposed to the internal space from the inner wall surface, and the heat insulating portion is configured to thermally insulate the first connection portion and the second connection portion from the cooling water passage so that the first connection portion and the second connection portion are not cooled easily by the cooling water in the cooling water passage.

2. The turbocharger according to claim 1, wherein the heat insulating portion is a cavity filled with air.

3. The turbocharger according to claim 2, wherein the heat insulating portion is not opened in the inner wall surface.

* * * * *